US006213621B1

(12) United States Patent
Chien

(10) Patent No.: US 6,213,621 B1
(45) Date of Patent: Apr. 10, 2001

(54) TOOL KIT WITH ILLUMINATION FUNCTION

(76) Inventor: Kuo Cheng Chien, No. 41, Lane 197, Cheng Kwang St., Taiping City, Taichung, Hsien (TW)

( * ) Notice: Subject to any disclaimer, the term of this patent is extended or adjusted under 35 U.S.C. 154(b) by 0 days.

(21) Appl. No.: 09/459,943

(22) Filed: Dec. 14, 1999

(51) Int. Cl.[7] ..... B25B 23/18

(52) U.S. Cl. ..... 362/119; 362/109; 362/120; 362/578; 362/253; 81/54; 81/29

(58) Field of Search ..... 362/109, 119, 362/120, 578, 253; 81/53, 54, 29

(56) References Cited

U.S. PATENT DOCUMENTS 5,873,648 * 2/1999 Shiao ..... 362/119

6,022,121 * 2/2000 Lin ..... 362/119

* cited by examiner

*Primary Examiner*—Sandra O'Shea
*Assistant Examiner*—Ali Alavi
(74) *Attorney, Agent, or Firm*—Rosenberg, Klein & Lee

(57) ABSTRACT

A tool kit with illuminating function, having a grip and a transparent cover shade connected with the front end of the grip. A front tool connecting section of the transparent cover shade is detachably connected with a tool kit tightened and fixed by a fixing cap. A user can rotate a cover board to align a taking hole thereof with the engaging hole of the main body of the tool kit so as to conveniently take out the tool head. When the taking hole is disaligned from the engaging hole, the tool head is prevented from dropping out so that the kit of tool heads can be reliably located in the tool kit.

5 Claims, 7 Drawing Sheets

TOOL KIT WITH ILLUMINATION FUNCTION

BACKGROUND OF THE INVENTION

The present invention relates to a tool kit with illuminating function, and more particularly to a tool kit having a tool connecting section detachably connected with a tool kit. A cover board serves to prevent the tool heads from dropping out of the tool kit.

FIGS. 6 and 7 show a conventional screwdriver with illuminating function. The screwdriver has a grip 8 made of transparent material. The center of the front end of the grip 8 is disposed with an elongated tool stem 81. The periphery of the tool stem 81 is formed with multiple engaging holes 82 for engaging with a tool head 7. A kit of tool heads 7 can be placed at the end section of the tool stem 81. The outer periphery of the front section of the grip 8 is disposed with an engaging groove 83. A flange 841 of a transparent cover shade 84 can be engaged into the engaging groove to make the cover shade 84 cover the front section of the grip 8 and prevent the tool head 7 from dropping out. An illuminating device 9 is disposed in the grip 8. A bottom cap 85 is screwed with the rear end of the grip 8. The center of the bottom cap 85 is disposed with a resilient push button 86 for touching and controlling the switch 91 of the illuminating device 9, whereby the light of the illuminating device 9 can be projected toward the front side of the grip 8 to provide illumination in working.

In the above screwdriver, the tool heads 7 are placed in the engaging holes 82. However, when replacing and taking out the tool head 7, it is necessary to open the entire cover shade 84 and take out the cover shade along the tool stem 81. After the tool head 7 is taken out, the cover shade 84 is again fitted back through the tool stem 81. Therefore, it is inconvenient to take out the tool head 7. Moreover, in practice, in order to avoid the tool head 7 from unexpectedly dropping out, the tool head 7 must be tightly fitted in the engaging hole 82. Therefore, it costs greater strength to extract out the tool head 7.

SUMMARY OF THE INVENTION

It is therefore a primary object of the present invention to provide a tool kit with illuminating function. The tool kit is tightened and fixed by a fixing cap and user can rotate a cover board to align a taking hole thereof with the engaging hole of the main body of the tool kit so as to conveniently take out the tool head. When the taking hole is disaligned from the engaging hole, the tool head is prevented from dropping out so that the kit of tool heads can be reliably located in the tool kit.

According to the above object, the tool kit with illuminating function of the present invention includes:

- a hollow grip for receiving therein an illuminating cell unit, two ends of the grip being formed with outer threads;
- a bottom cap screwed on the outer thread of the rear end of the grip, a center of the bottom cap being disposed with a resilient push button for pressing the illuminating cell unit to control on/off of the power therefor; and
- a transparent cover shade having a tool connecting section and a grip connecting section, the tool connecting section having an elongated tool stem, an end section of the tool stem being replaceably connected with a kit of tool heads, the transparent cover shade being passed through a top cap which is screwed on the outer thread of the front end of the grip for fixing the transparent cover shade.

The tool kit is characterized in that the circumference of the tool connecting sect ion of the transparent cover shade is detachably connected with a tool kit. A front end of the tool connecting sect ion being disposed with a fixing cap which can be screwed and tightened. The tool kit is made of transparent material and has a substantially ring-shaped main body formed with multiple internal engaging holes for receiving a kit of tool heads therein. The front end of the main body has a small diameter section on which a cover board is fitted. The cover board is formed with a taking hole which can be aligned with one of the engaging holes by means of rotating the cover board. The entire tool kit is fitted with the tool connecting section and tightened and fixed by the fixing cap.

The present invention can be best understood through the following description and accompanying drawings wherein:

DETAILED DESCRIPTION OF THE PREFERRED EMBODIMENT

Figure 1:
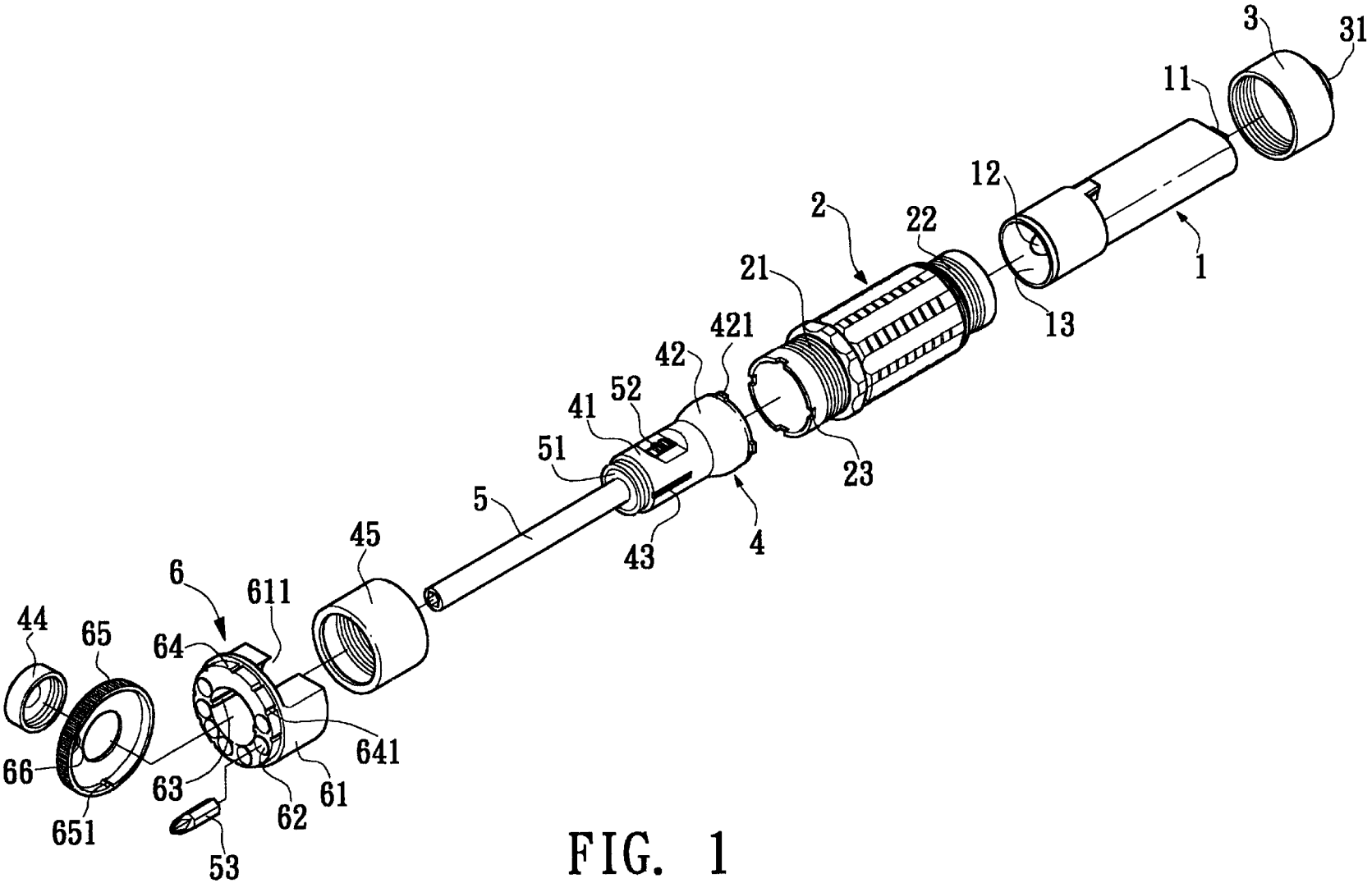
FIG. 1 is a perspective exploded view of the present invention.
Figure 2:
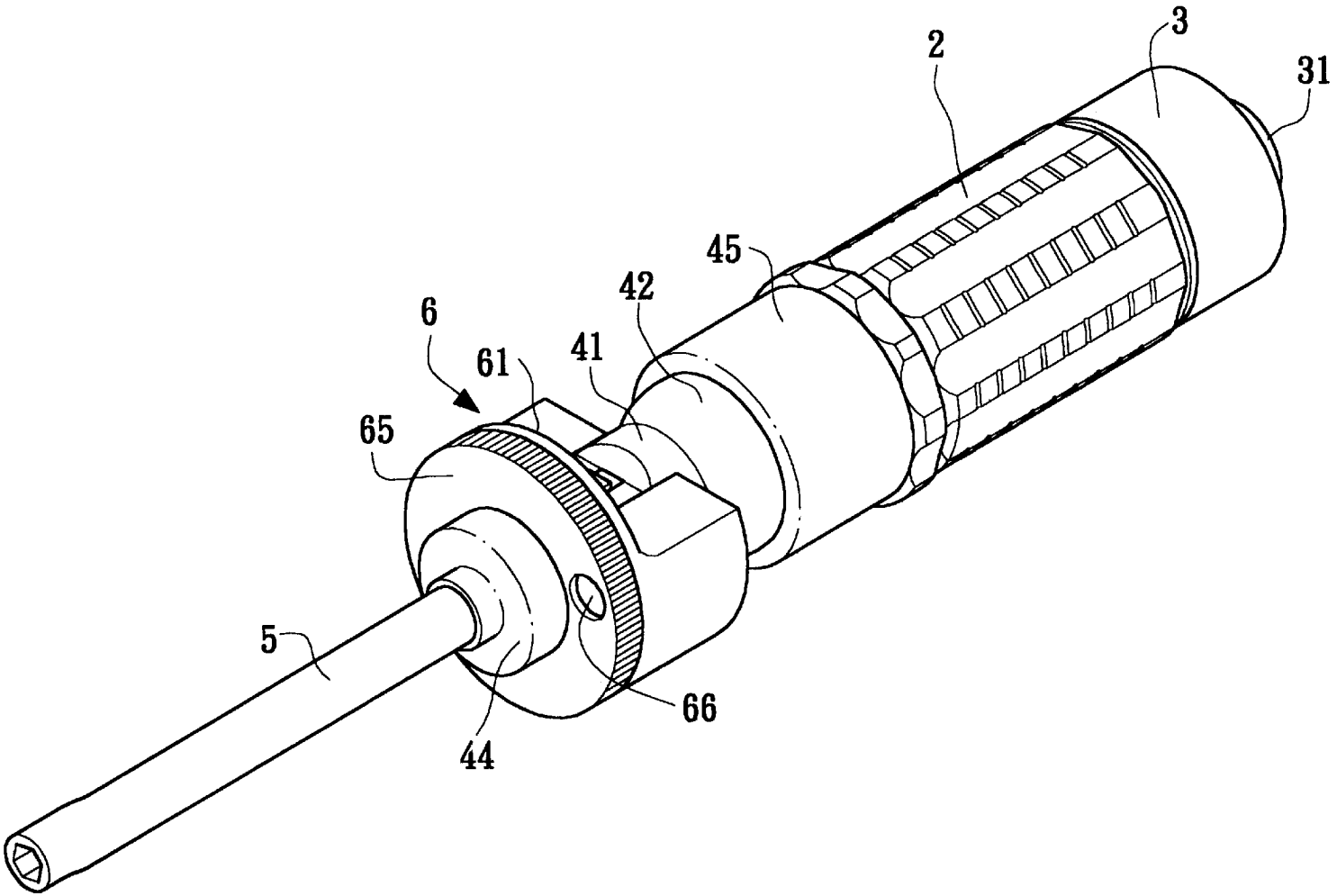
FIG. 2 is a perspective assembled view of the present invention.
Figure 3:
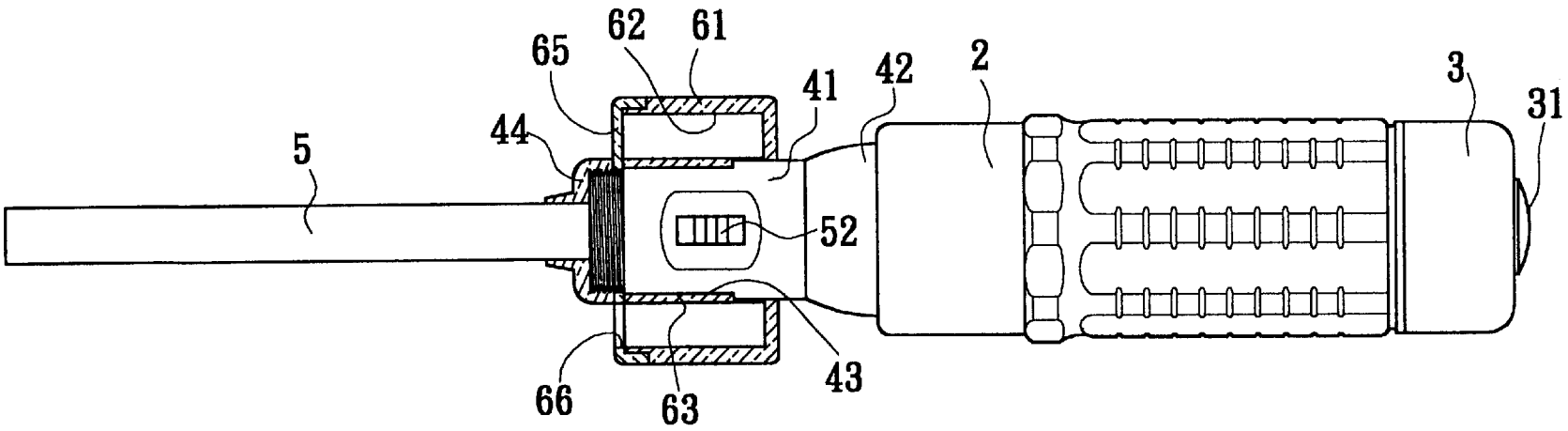
FIG. 3 is a sectional view taken along line III—III of FIG. 2.
Figure 4:
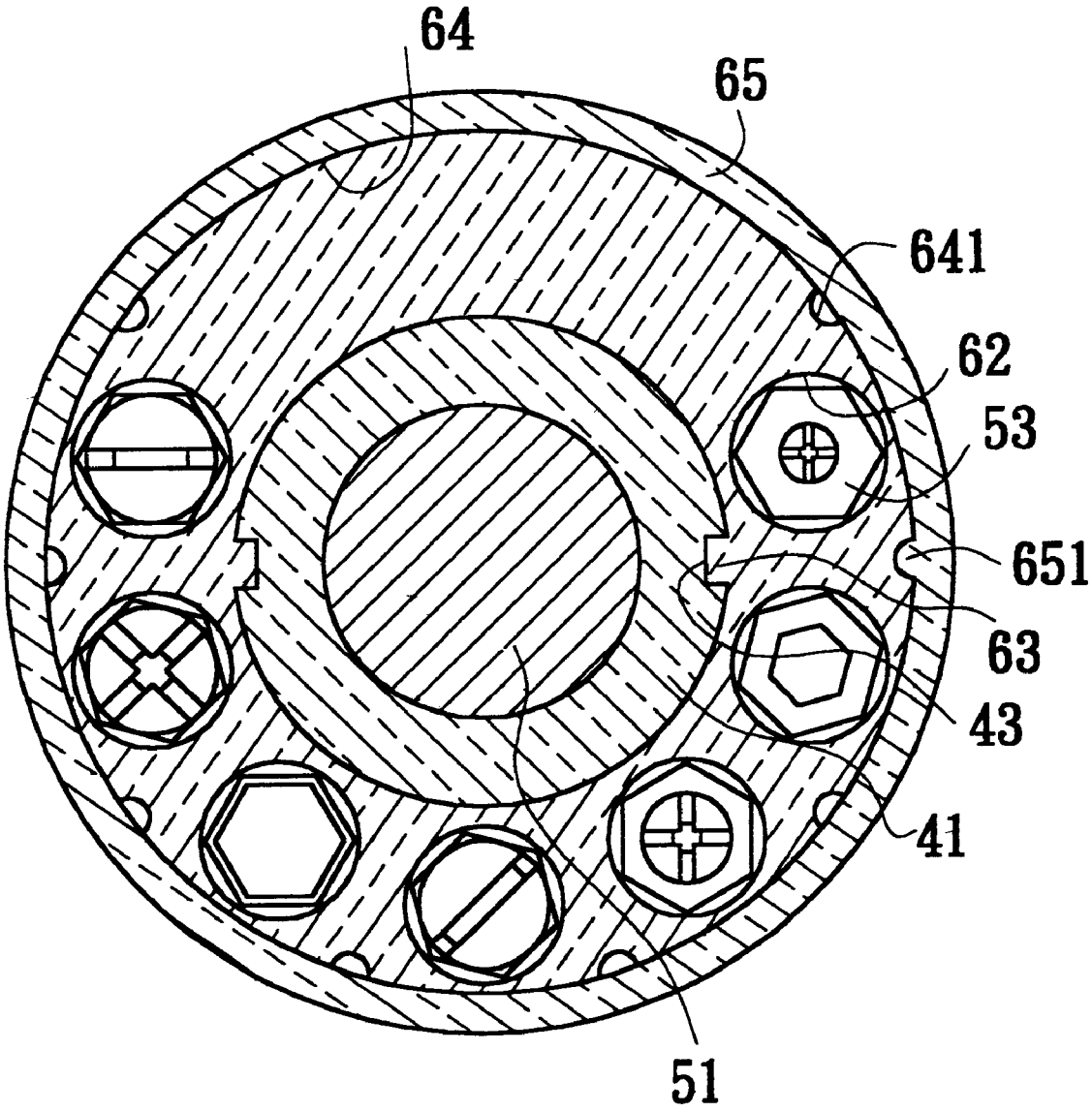
FIG. 4 is a sectional view taken along line IV—IV of FIG. 2.

Please refer to FIGS. 1 to 4. According to a preferred embodiment, the tool kit of the present invention includes:

an illuminating cell unit 1, a rear end of the illuminating cell unit 1 being disposed with a press switch 11, a front end of the illuminating cell unit 1 being disposed with a bulb 12 and a light shade 13 for making the light of the bulb 12 projected forward;

- a hollow grip 2, two ends of the grip 2 being formed with outer threads 21, 22, the end face of the outer thread 21 of the front end being formed with multiple locating notches 23, the illuminating cell unit 1 being positioned in the grip 2;
- a bottom cap 3 screwed on the outer thread 22 of the rear end of the grip 2, the center of the bottom cap 3 being disposed with a resilient push button 31 for pressing the press switch 11 of the illuminating cell unit 1 to control on/off of the power;
- a transparent cover shade 4 having a tool connecting section 41 and a grip connecting section 42, the end edge of the grip connecting section 42 being formed with multiple locating blocks 421 for inserting into the locating notches 23 of the grip 2, a top cap 45 being screwed on the outer thread 21 of the front end of the grip 2 for fixing the transparent cover shade 4, a ratchet mechanism 51 being disposed in the tool connecting section 41, the ratchet mechanism 51 having a forward extending tool stem 5, the end section of the tool stem 5 being replaceably connected with a kit of tool heads 53, the ratchet mechanism 51 having a switch 52 protruding out of the outer circumference of the tool connecting section 41, the circumference of the tool connecting section 41 being formed with two axially extending channels 43, a fixing cap 44 being screwed with the front end of the tool connecting section 41; and a tool kit 6 fitted around the tool connecting section 41, the tool kit 6 having a substantially ring-shaped main body 61 formed with multiple internal engaging holes 62 at intervals for receiving a kit of tool heads 53 therein, the intervals between the respective engaging holes 62 permitting the light of the illuminating cell unit 1 to pass therethrough for illumination, the inner circumferential wall of the main body 61 being formed with projections 63 corresponding to the channels 43 of the tool connecting section 41 for inserting into the channels 43, the front end of the main body 61 having a small diameter section 64 on which a cover board 65 is fitted, the outer circumference of the small diameter section 64 being formed with multiple engaging grooves 641 arranged at positions corresponding to the respective engaging holes 62 and a non-engaging hole section.

The cover board 65 is formed with a taking hole 66 which can be aligned with one of the engaging holes 62 by means of rotating the cover board 65. The inner circumference of the cover board 65 is disposed with an engaging rib 651 for engaging into the engaging groove 641 of the main body 61. The tool kit 6 is fitted with the tool connecting section 41 and tightened by the fixing cap 44. In addition, the main body 61 of the tool kit 6 is formed with a recess 611 corresponding to the switch 52 of the ratchet mechanism 51 for a user to operate the switch 52.

Figure 5:
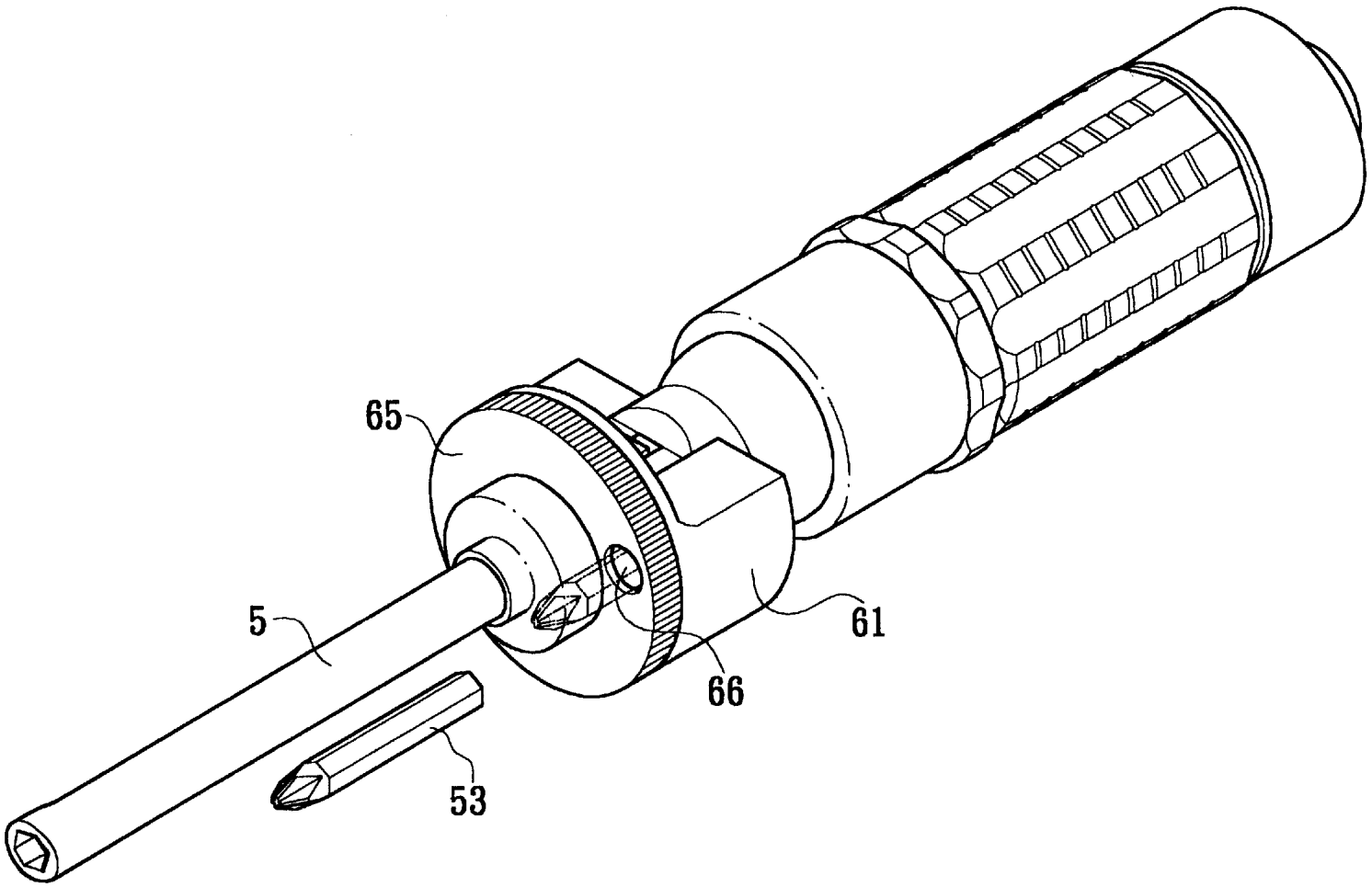
FIG. 5 shows that the tool head is taken out from the tool kit of the present invention.
Figure 6:
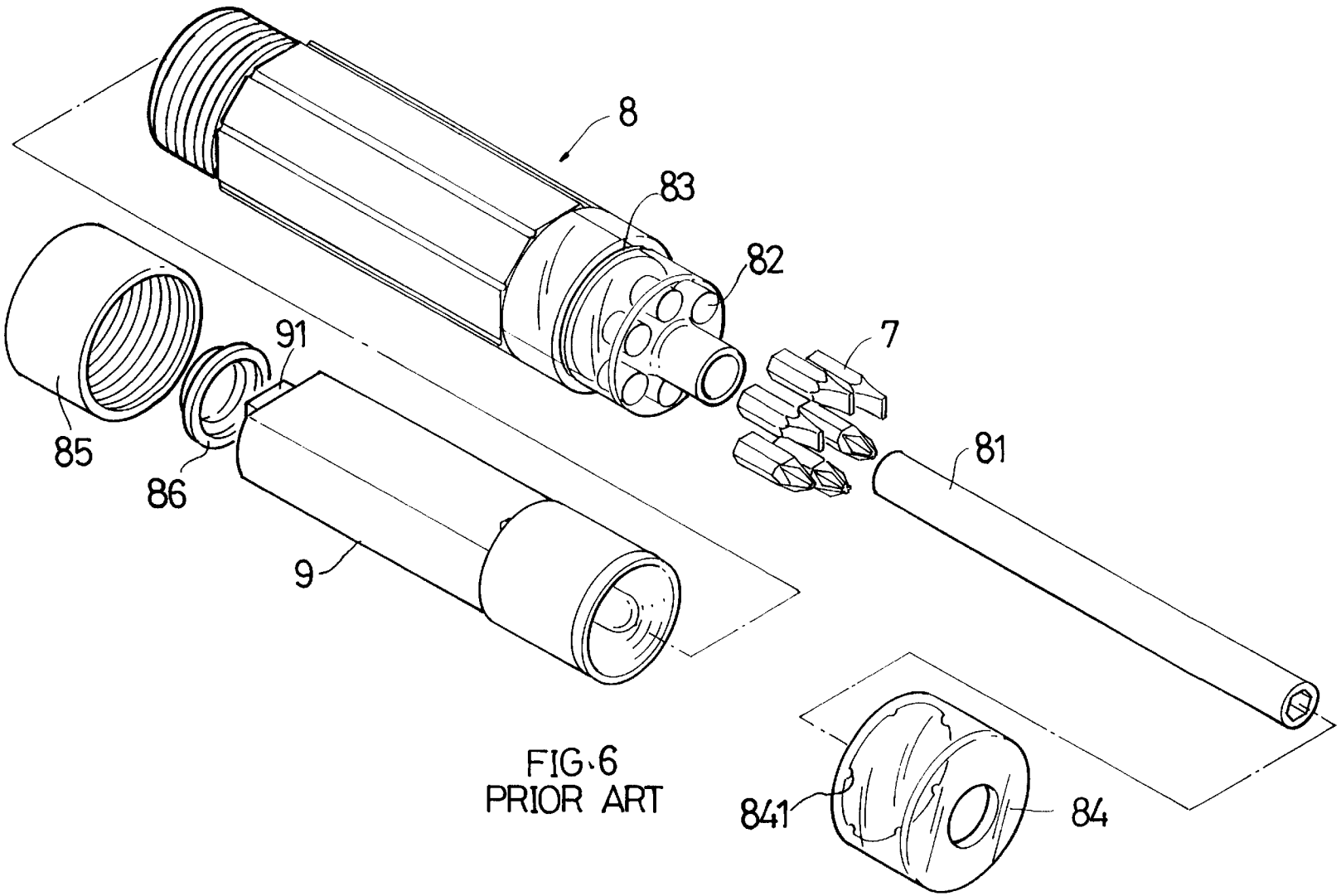
FIG. 6 PRIOR ART
FIG. 6 is a perspective exploded view of a conventional screwdriver with illuminating function.
Figure 7:
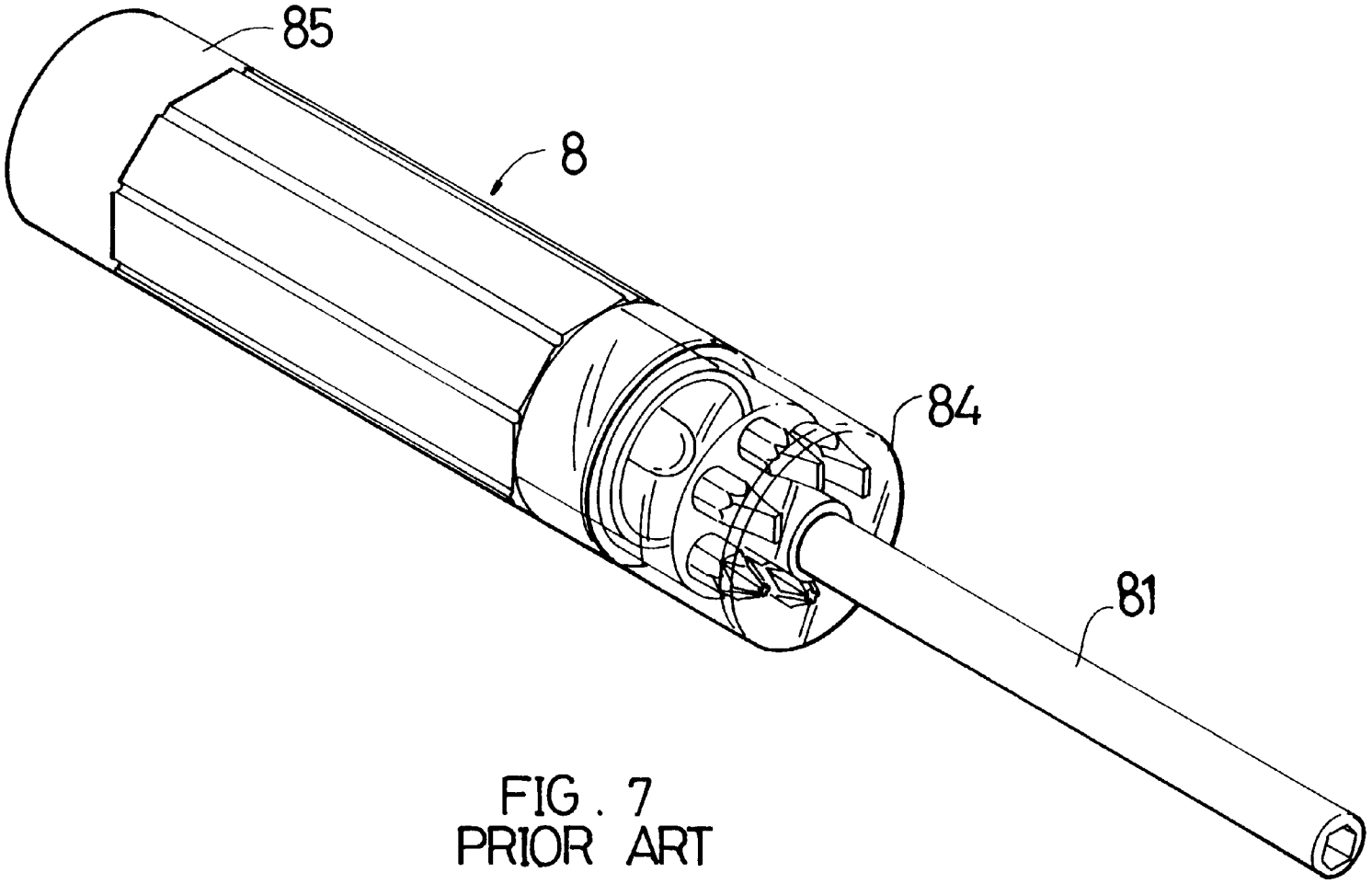
FIG. 7 PRIOR ART
FIG. 7 is a perspective assembled view of the conventional screwdriver with illuminating function.

The entire tool kit 6 is tightly fixed on the tool connecting section 41 by the fixing cap 44 so that the tool kit 6 is prevented from being axially displaced. In addition, the projections 63 of the main body 61 of the tool kit 6 are inserted in the channels 43 of the tool connecting section 41 so that the tool kit 6 is prevented from being rotated. Therefore, the tool kit 6 can be firmly connected with the tool connecting section 41. The engaging rib 651 of the cover board 65 is engaged in the engaging groove 641 of the tool kit 6, whereby the taking hole 66 of the cover board 65 can be naturally aligned with the engaging hole 62 for taking out the tool head 53 as shown in FIG. 5. When the taking hole 66 of the cover board 65 is positioned at the non-engaging hole section, the taking hole 66 is disaligned from the engaging hole 62 so that the tool head 53 is prevented from dropping out.

The tool kit 6 is made of transparent material and there are intervals between the engaging holes 62 so that when illumination is required, the light of the illuminating cell unit 1 can pass through the tool kit 6 to forward project onto the working range and provide necessary illumination.

According to the above arrangement, the tool kit 6 is fixed by the fixing cap 44 and a user can rotate the cover board 65 to align the taking hole 66 thereof with the engaging hole 62 of the main body 61 of the tool kit 6 so as to conveniently take out the tool head 53. When the taking hole 66 is disaligned from the engaging hole 62, the tool head 53 is prevented from dropping out so that the kit of tool heads 53 can be reliably located in the tool kit 6.

Moreover, in the case that the user wants to apply the present invention to a work piece necessitating higher precision and it is necessary enhance the freeness of the tool kit, the user can first turn and remove the fixing cap 44 and then take off the tool kit 6 and then again turn tight the fixing cap 44 so as to reduce the weight of the tool kit and enhance the freeness in use.

The above embodiment is only used to illustrate the present invention, not intended to limit the scope thereof. Many modifications of the above embodiment can be made without departing from the spirit of the present invention.

What is claimed is:

1. A tool kit with illuminating function, comprising:

a hollow grip, two ends of the grip being formed with outer threads, an illuminating cell unit being positioned in the grip;

a bottom cap screwed on the outer thread of the rear end of the grip, a center of the bottom cap being disposed with a resilient push button for pressing the illuminating cell unit to control on/off of the power therefor; and a transparent cover shade having a tool connecting section and a grip connecting sect ion, the tool connecting section having an elongated tool stem, an end section of the tool stem being replaceably connected with a kit of tool heads, the transparent cover shade being passed through a top cap which is screwed on the outer thread of the front end of the grip for fixing the transparent cover shade, said tool kit being characterized in that the circumference of the tool connecting section of the transparent cover shade is detachably connected with a tool kit, a front end of the tool connecting section being disposed with a fixing cap which can be screwed and tightened, the tool kit being made of transparent material and having a substantially ring-shaped main body formed with multiple internal engaging holes for receiving a kit of tool heads therein, the front end of the main body having a small diameter section on which a cover board is fitted, the cover board being formed with a taking hole which can be aligned with one of the engaging holes by means of rotating the cover board, the entire tool kit being fitted with the tool connecting sect ion and tightened and fixed by the fixing cap.

2. A tool kit with illuminating function as claimed in claim 1, wherein the engaging holes are arranged at intervals which permit the light of the illuminating cell unit to pass therethrough for illumination.

3. A tool kit with illuminating function as claimed in claim 1, wherein a ratchet mechanism is disposed at the rear end of the tool stem, the ratchet mechanism being received in the tool connecting section of the transparent cover shade, the ratchet mechanism having a switch protruding out of the outer circumference of the tool connecting section, the main body of the tool kit being formed with a recess corresponding to the switch of the ratchet mechanism for a user to operate the switch.

4. A tool kit with illuminating function as claimed in claim 1, wherein the outer circumference of the small diameter section of the main body of the tool kit is formed with multiple engaging grooves arranged at positions corresponding to the respective engaging holes and a non-engaging hole section, the inner circumference of the cover board being disposed with an engaging rib for engaging into the engaging groove of the main body.

5. A tool kit with illuminating function as claimed in claim 1, wherein the circumference of the tool connecting section is formed with over one axially extending channel, the inner circumferential wall of the main body of the tool kit being formed with a projection corresponding to the channel of the tool connecting section for inserting into the channel, whereby the tool kit can be detachably connected with the tool connecting section.

* * * * *